US008752559B1

(12) United States Patent
Tsai

(10) Patent No.: US 8,752,559 B1
(45) Date of Patent: Jun. 17, 2014

(54) HAIR COLOR WAX CHANGEABLE HAIR DYEING COMB

(71) Applicant: Kai-Mou Tsai, Taipei (TW)

(72) Inventor: Kai-Mou Tsai, Taipei (TW)

( * ) Notice: Subject to any disclaimer, the term of this patent is extended or adjusted under 35 U.S.C. 154(b) by 0 days.

(21) Appl. No.: 13/744,874

(22) Filed: Jan. 18, 2013

(51) Int. Cl.

| | |
|---|---|
| ***A45D 24/16*** | (2006.01) |
| ***A45D 24/00*** | (2006.01) |
| ***A45D 24/10*** | (2006.01) |
| ***A45D 24/04*** | (2006.01) |
| ***A45D 19/02*** | (2006.01) |
| ***A45D 24/22*** | (2006.01) |

(52) U.S. Cl.
CPC ..... *A45D 19/02* (2013.01); *A45D 24/10* (2013.01); *A45D 24/22* (2013.01)
USPC ..... 132/108; 132/109; 132/126; 132/148; 132/150

(58) Field of Classification Search
CPC ... A45D 19/00; A45D 19/02; A45D 19/0008; A45D 24/08; A45D 24/10; A45D 24/16; A45D 24/22; A45D 2019/0066; A45D 2019/0083; A45D 2019/0091; A45D 2019/02
USPC ..... 132/108, 200, 208, 212, 218, 219, 104, 132/106, 107, 109–112, 116, 120, 125, 126, 132/141, 142, 143, 147–150, 155, 162, 313, 132/314, 317, 221, 270; 15/104.93, 184, 15/186, 39, 142; 119/600, 601, 602, 611, 119/613, 614, 625, 633, 652; D28/20–22, D28/30, 74, 7; 401/262, 269, 268, 49, 59, 401/60, 179, 199; D30/158, 159
See application file for complete search history.

(56) References Cited

U.S. PATENT DOCUMENTS

| | | | | | |
|---|---|---|---|---|---|
| 930,678 | A | * | 8/1909 | Moore | 132/126 |
| 1,487,374 | A | * | 3/1924 | De Bassini | 132/108 |
| 1,707,665 | A | * | 4/1929 | Julien | 132/125 |
| 2,154,822 | A | * | 4/1939 | Quisling | 514/781 |
| 2,164,073 | A | * | 6/1939 | Madore | 132/122 |
| 2,705,499 | A | * | 4/1955 | Breeze | 132/109 |
| 2,761,459 | A | * | 9/1956 | Kaul | 132/109 |
| 2,774,096 | A | * | 12/1956 | Taylor | 15/203 |
| 2,797,695 | A | * | 7/1957 | Fortmann | 132/110 |
| 2,946,072 | A | * | 7/1960 | Filler et al. | 15/110 |
| 3,491,777 | A | * | 1/1970 | Grosbard | 132/120 |
| 3,640,288 | A | * | 2/1972 | Spanel | 132/212 |
| 3,828,802 | A | * | 8/1974 | Spanel | 132/212 |
| 4,013,086 | A | * | 3/1977 | Chmela | 132/110 |
| D286,952 | S | * | 12/1986 | Leroux | D4/136 |
| 4,747,420 | A | * | 5/1988 | Alaimo | 132/112 |
| 5,062,435 | A | * | 11/1991 | Ohtsuka | 132/108 |
| 5,325,878 | A | * | 7/1994 | McKay | 132/116 |
| 7,156,885 | B2 | * | 1/2007 | Kennedy et al. | 8/405 |

* cited by examiner

*Primary Examiner* — Vanitha Elgart
(74) *Attorney, Agent, or Firm* — Rosenberg, Klein & Lee

(57) ABSTRACT

A hair color wax changeable hair dyeing comb includes a comb body having a track extending along the length thereof at one side and partially surrounded by comb teeth and a longitudinal rail disposed in one end of the track, a hair color wax assembly detachably coupled to the longitudinal rail of the comb body for application, and a sliding cover coupled to and movable along the track of the comb body between a close position to keep the hair color wax assembly from sight and an open position to expose the hair color wax assembly for application.

4 Claims, 5 Drawing Sheets

HAIR COLOR WAX CHANGEABLE HAIR DYEING COMB

BACKGROUND OF THE INVENTION

1. Field of the Invention

The present invention relates to hair dyeing technology and more particularly, to a hair color wax changeable hair dyeing comb, which includes a comb body, a hair color wax assembly detachably mounted in the comb body for coloring the hair of a person and a sliding cover coupled to the comb body and movable between a close position to keep the hair color wax assembly from sight and an open position to expose the hair color wax assembly for application or replacement.

2. Description of the Related Art

When dyeing the hair of a person, people may use a regular hair comb to pick up a certain amount of a hair color wax or gel and then comb the hair to apply the hair color wax or gel to the hair. Alternatively, a hair dye comb may be used to apply a hair color wax or gel to the hair. A hair dye comb for dyeing hair generally comprises a container mounted in the comb body for holding a hair dyeing fluid. The container has a nozzle for dispensing the contained hair dyeing fluid. When dyeing the hair of a person in either of the aforesaid two conventional methods, it is difficult to control the dispensing amount of the hair dyeing fluid, and other part of the body may be contaminated by the hair dyeing fluid accidentally. Therefore, the aforesaid conventional hair dye comb has the drawbacks of being not convenient to carry and to use. Further, commercial hair dyeing combs commonly have a complicated structure. Further, the hair dyeing fluid may leak out accidentally.

SUMMARY OF THE INVENTION

U.S. patent application Ser. No. 13/672,857, invented by the present inventor, discloses a hair dyeing comb, which can be used for styling, cleaning, managing and dyeing hair conveniently and, which has a simple structure and is inexpensive to manufacture. However, this design of hair dyeing comb does not allow change of the hair color wax.

Therefore, it is the main object of the present invention to provide a hair color wax changeable hair dyeing comb that allows change of the hair color wax.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
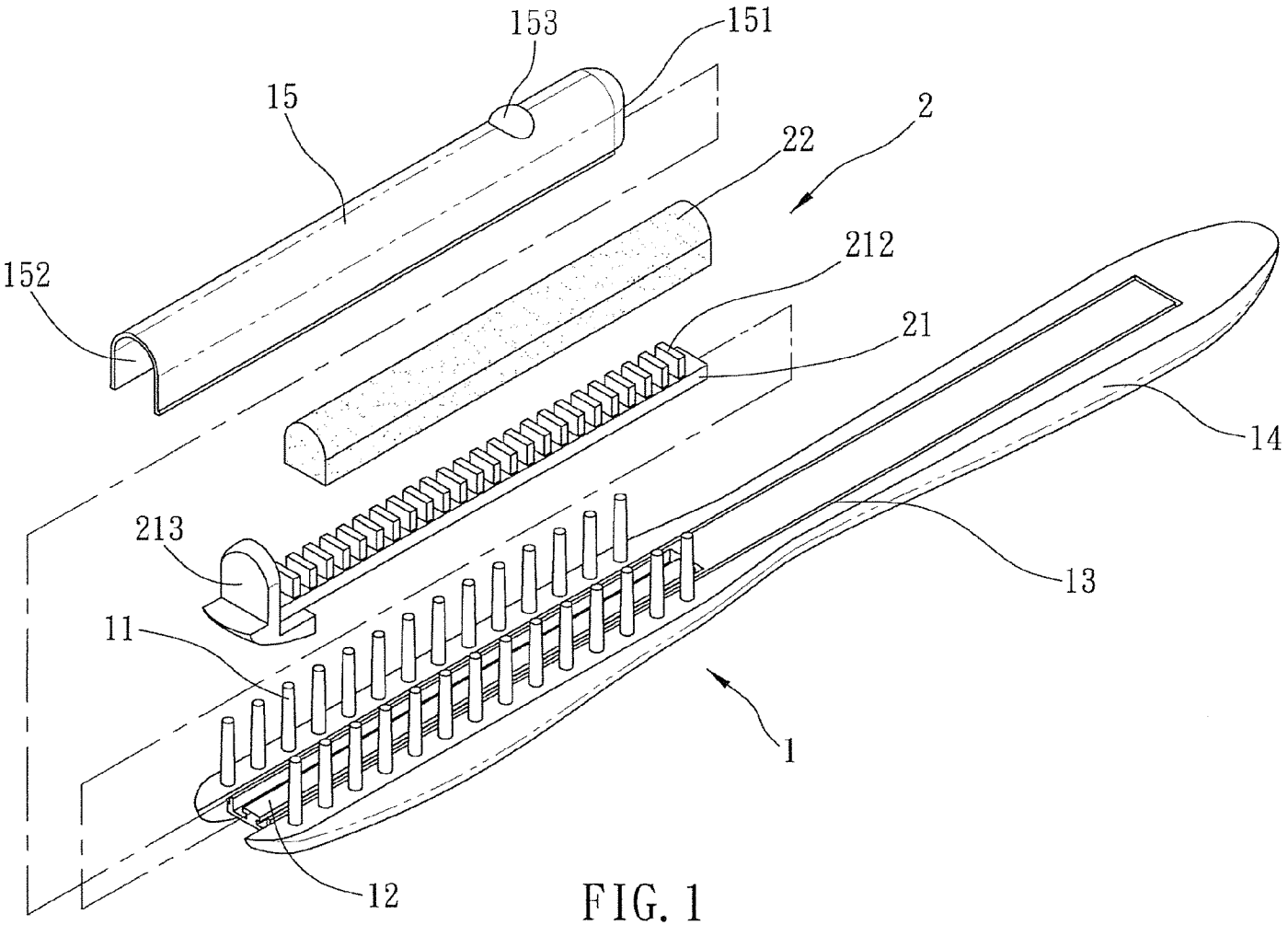
FIG. 1 is an exploded view of a hair color wax changeable hair dyeing comb in accordance with the present invention.
Figure 2:
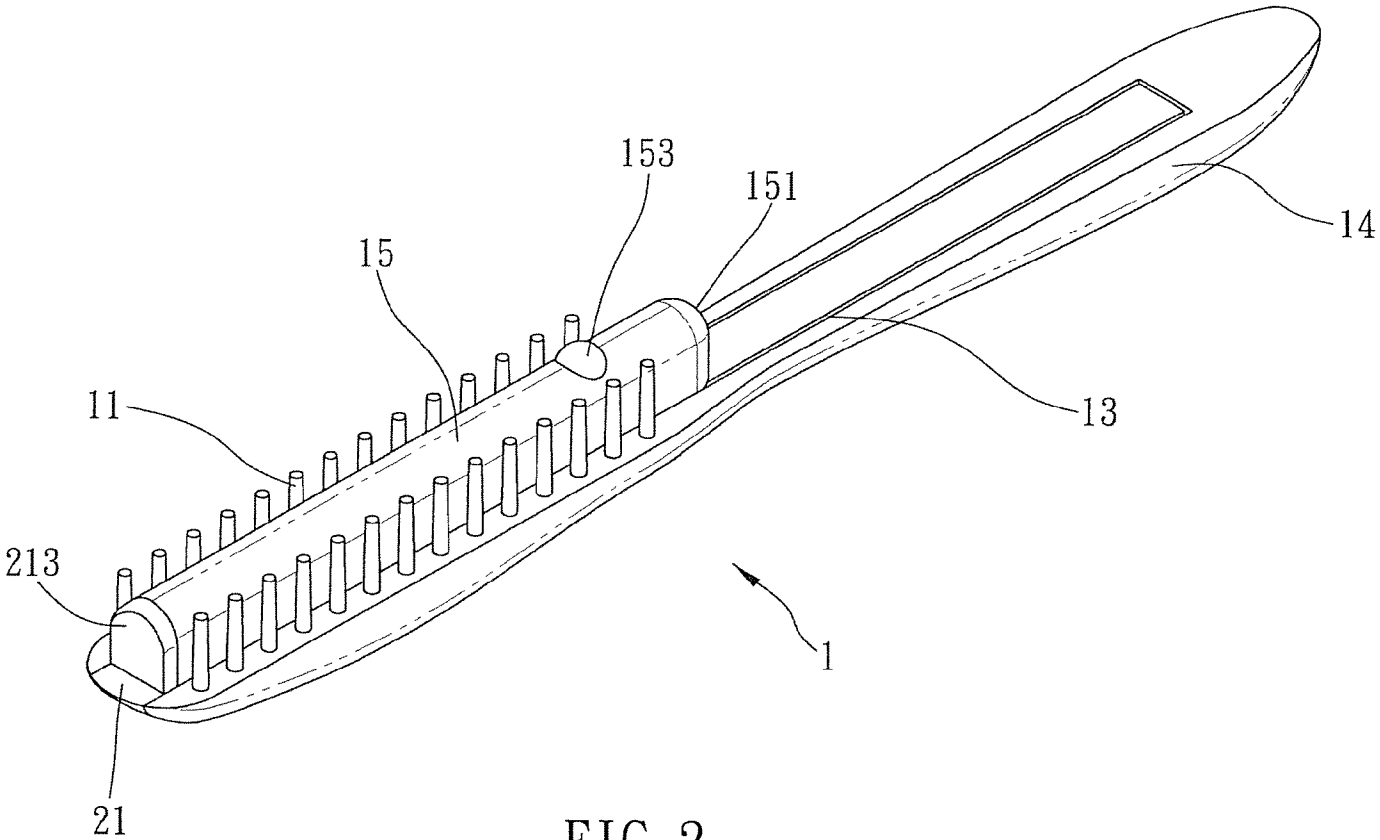
FIG. 2 is an elevational assembly view of the hair color wax changeable hair dyeing comb in accordance with the present invention.
Figure 3:
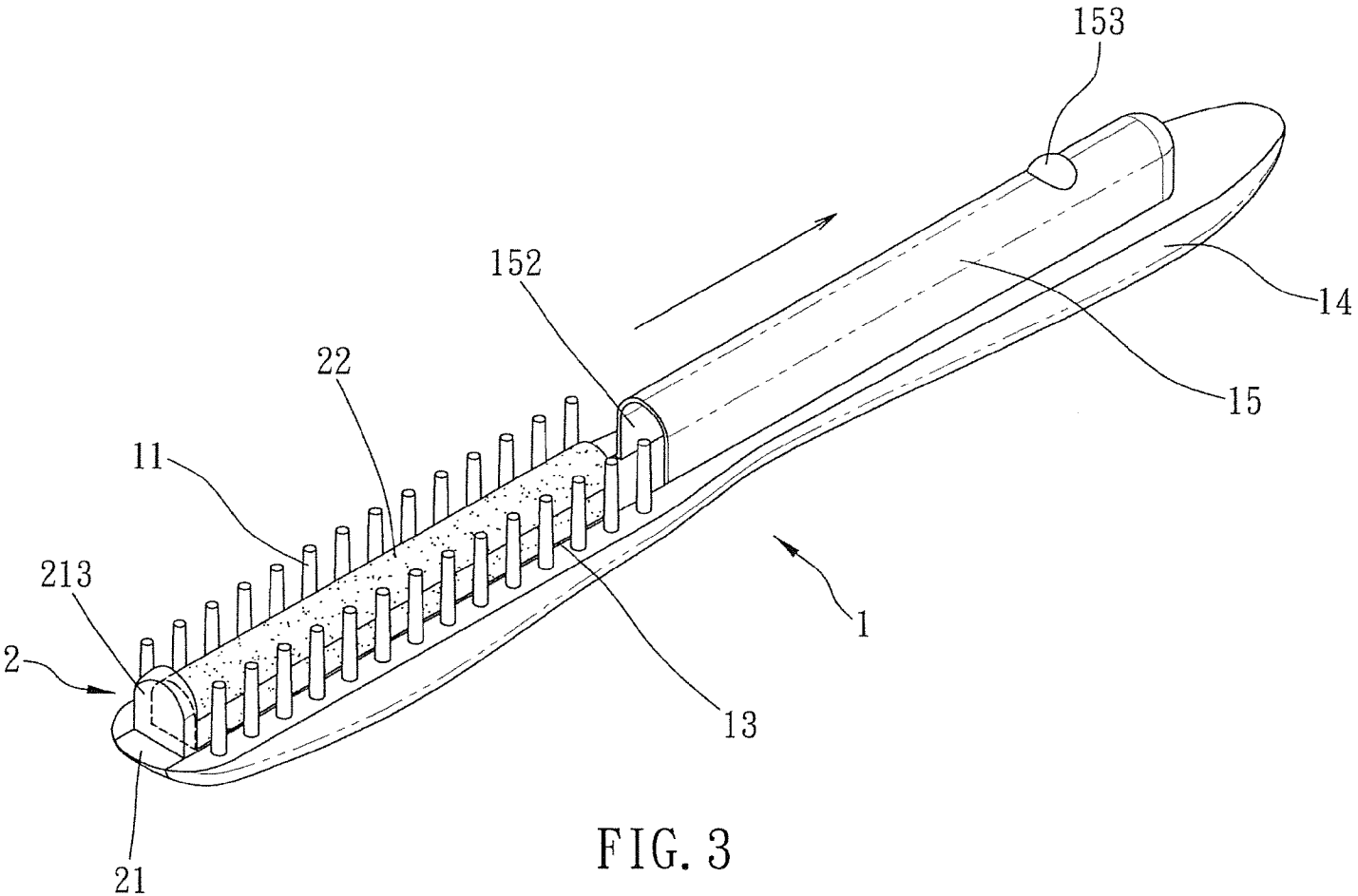
FIG. 3 is a schematic applied view of the present invention, illustrating the sliding cover in the open position.
Figure 4:
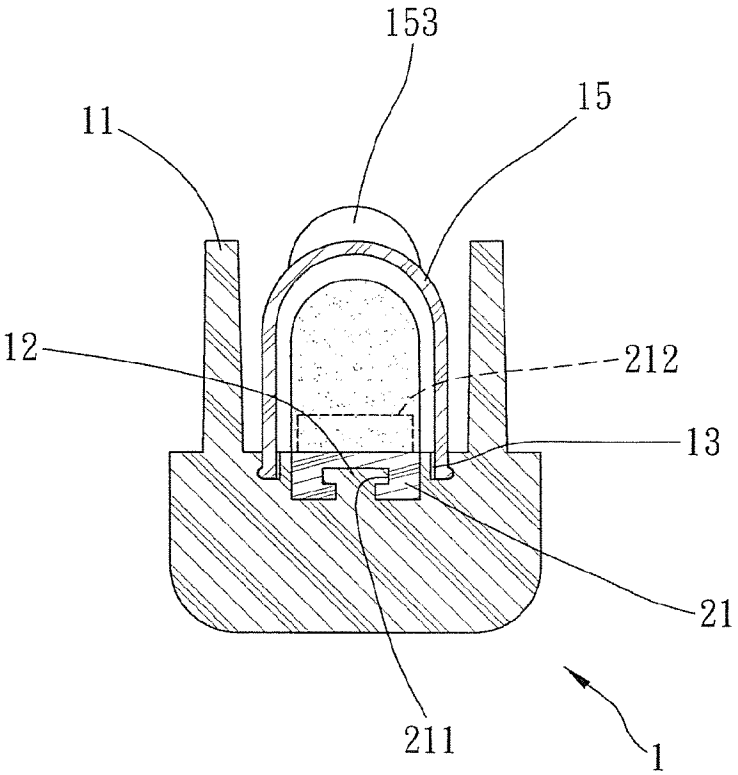
FIG. 4 is a cross sectional view, in an enlarged scale, of the hair color wax changeable hair dyeing comb in accordance with the present invention.

Referring to FIGS. 1-4, a hair color wax changeable hair dyeing comb in accordance with the present invention is shown. The hair color wax changeable hair dyeing comb comprises a comb body 1, a sliding cover 15, and a hair color wax assembly 2.

The comb body 1 comprises a handle 14 located at one end thereof, a track 13 located at one side thereof and extended to the handle 14, a plurality of comb teeth 11 perpendicularly arranged around one end of the track 13 beyond the handle 14, a longitudinal rail 12 disposed in the track 13 and surrounded by the comb teeth 11, and a stop block 213 disposed adjacent to one end of the track 13.

The hair color wax assembly 2 comprises a wax carrier 21 and an elongated block of hair color wax 22. The wax carrier 21 comprises an elongated carrier base 211 detachably and slidably coupled to the longitudinal rail 12 of the comb body 1, a longitudinal series of transverse tooth blocks 212 arranged at the top side of the elongated carrier base 211, and a stop block 213 located at one end of the elongated carrier base 211. The elongated block of hair color wax 22 is attached to the longitudinal series of transverse tooth blocks 212 of the wax carrier 21 for coloring the hair 3 of a person when the user is combing the hair with the hair color wax changeable hair dyeing comb.

Figure 5:
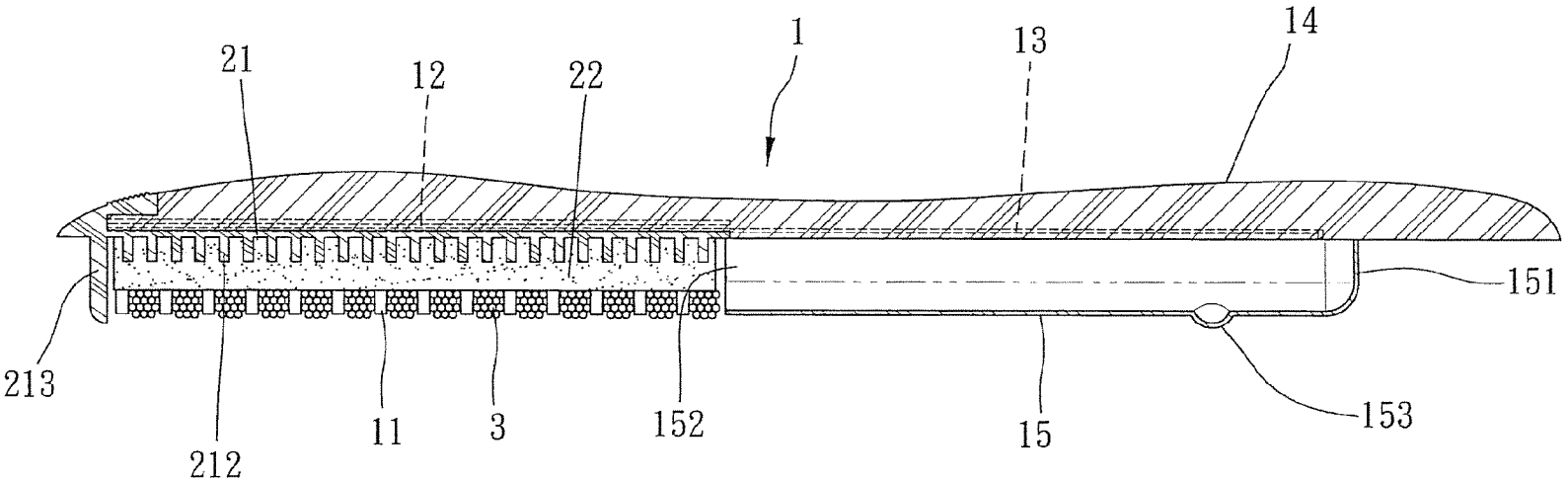
FIG. 5 is a schematic sectional side view of the hair color wax changeable hair dyeing comb in accordance with the present invention, illustrating the sliding cover in the open position.

The sliding cover 15 is an elongated and transversely arched cover plate coupled to and movable along the track 13 of the comb body 1 between a close position (see FIG. 2) and an open position (see FIG. 3 and FIG. 5), having opposing close end 151 and open end 152, and a thumb block 153 protruded from the top side thereof.

When the hair color wax changeable hair dyeing comb is not in use, the user can move the sliding cover 15 along the track 13 of the comb body 1 to abut the open end 152 against the stop block 213 of the wax carrier 21, keeping the hair color wax assembly 2 from sight and protecting it against dust. Further, the sliding cover 15 can be moved along the track 13 of the comb body 1 to the open position, allowing removal of the hair color wax assembly 2 from the comb body 1 for a replacement.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A hair color wax changeable hair dyeing comb, comprising:

a comb body comprising a handle disposed at a first end thereof, a plurality of comb teeth perpendicularly arranged at a second end of said comb body, a track extending longitudinally between said first and second ends, and a longitudinal rail disposed in said track and surrounded by said comb teeth;

a hair color wax assembly comprising a wax carrier and an elongated block of hair color wax, said wax carrier comprising an elongated carrier base detachably and slidably coupled to said longitudinal rail of said comb body and a longitudinal series of transverse tooth blocks arranged at a top side of said elongated carrier base, said elongated block of hair color wax being attached to said longitudinal series of transverse tooth blocks of said comb body for coloring the hair of a person; and a sliding cover retentively coupled to said comb body to be movable along said track of said comb body between a close position at the second end of said comb body to cover and keep said hair color wax assembly from sight and an open position at the first end of said comb body to expose said hair color wax assembly for application, said sliding cover defining opposing close end and open end.

2. The hair color wax changeable hair dyeing comb as claimed in claim 1, wherein said sliding cover comprises a thumb block protruded from a top side thereof.

3. The hair color wax changeable hair dyeing comb as claimed in claim 1, wherein said wax carrier further comprises a stop block located at one end thereof for stopping against the open end of said sliding cover.

4. The hair color wax changeable hair dyeing comb as claimed in claim 1, wherein said elongated carrier base of said wax carrier is retentively engaged by said longitudinal rail of said comb body in slidably displaceable manner.

* * * * *